US008215726B1

(12) United States Patent
Klassen

(10) Patent No.: US 8,215,726 B1
(45) Date of Patent: Jul. 10, 2012

(54) APPARATUS AND METHOD FOR SEAMLESS RIGID COUNTERTOP

(75) Inventor: Cameron D. Klassen, Gentry, AR (US)

(73) Assignee: Dream Fab, LLC, Gravette, AR (US)

( * ) Notice: Subject to any disclaimer, the term of this patent is extended or adjusted under 35 U.S.C. 154(b) by 0 days.

(21) Appl. No.: 12/587,582

(22) Filed: Oct. 8, 2009

Related U.S. Application Data

(63) Continuation of application No. 10/961,390, filed on Oct. 8, 2004, now abandoned, which is a continuation-in-part of application No. 10/395,487, filed on Mar. 21, 2003, now abandoned.

(60) Provisional application No. 60/366,719, filed on Mar. 22, 2002.

(51) Int. Cl.
*A47B 96/18* (2006.01)

(52) U.S. Cl. ..... 312/140.1; 427/202

(58) Field of Classification Search ..... 312/140.1–140.3
See application file for complete search history.

(56) References Cited

U.S. PATENT DOCUMENTS

| | | | | |
|---|---|---|---|---|
| 2,539,463 | A * | 1/1951 | Norquist | 108/27 |
| 2,887,103 | A | 5/1959 | Reeves | 126/214 |
| 3,385,284 | A | 5/1968 | White | 126/37 |
| 3,979,542 | A | 9/1976 | Perantoni et al. | 428/204 |
| 4,072,656 | A * | 2/1978 | Hartmann | 528/124 |
| 4,558,657 | A | 12/1985 | Rohrbach | 118/70 |
| 5,163,536 | A | 11/1992 | Tuhro et al. | 186/44 |
| 5,168,719 | A | 12/1992 | Branz et al. | 62/258 |
| 5,238,749 | A * | 8/1993 | Cueman et al. | 428/441 |
| 5,595,427 | A | 1/1997 | Peters et al. | 312/140.4 |
| 6,136,370 | A | 10/2000 | Muthiah et al. | 427/189 |
| 6,177,499 | B1 | 1/2001 | Minghetti | 524/437 |
| 6,238,750 | B1 * | 5/2001 | Correll et al. | 427/521 |
| 6,258,190 | B1 | 7/2001 | Sciarrino et al. | 156/71 |
| 6,309,035 | B1 | 10/2001 | Lye et al. | 312/140.4 |
| 6,433,099 | B1 | 8/2002 | Nicholl et al. | 525/327.3 |
| 6,534,178 | B2 | 3/2003 | Zhou et al. | 428/413 |
| 6,562,468 | B2 | 5/2003 | Wegert et al. | 428/447 |
| 6,588,760 | B2 | 7/2003 | Carter, Jr. et al. | 273/448 |
| 6,622,510 | B2 | 9/2003 | Giroux et al. | 62/342 |
| 7,629,400 | B2 * | 12/2009 | Hyman | 524/106 |

FOREIGN PATENT DOCUMENTS

| | | |
|---|---|---|
| AU | 673978 | 11/1996 |
| JP | 11290772 | 10/1999 |

* cited by examiner

*Primary Examiner* — Hanh V Tran

(74) *Attorney, Agent, or Firm* — Keisling & Pieper, PLC; Trent C. Keisling; Stephen D. Schrantz

(57) ABSTRACT

The method of construction of seamless countertops of the present invention enables the user to advantageously combine cabinet making with metalworking and powder coating to produce novel seamless countertops. The improved countertops are constructed by making a template of the countertop to create a countertop pattern. Discrete metallic sheets are then shaped according to the countertop pattern and joined together by welding to form a metal core. The metal core is then smoothed and powder coated to form a unitary, seamless countertop.

2 Claims, 13 Drawing Sheets

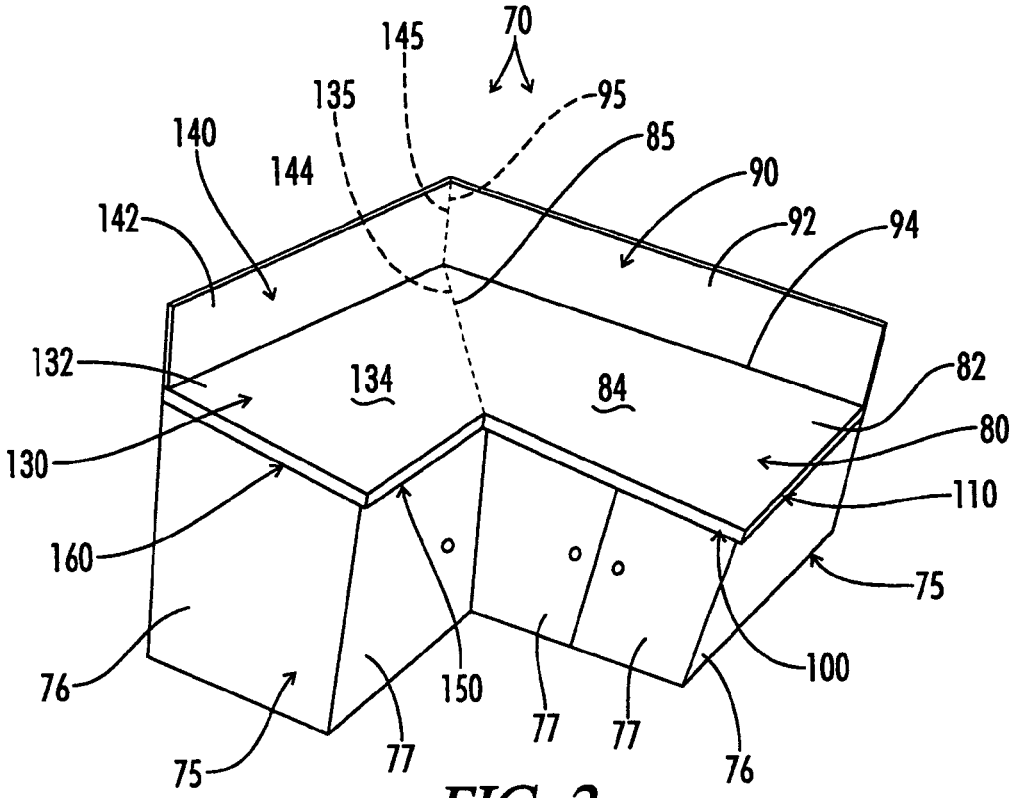
FIG. 2
FIG. 3
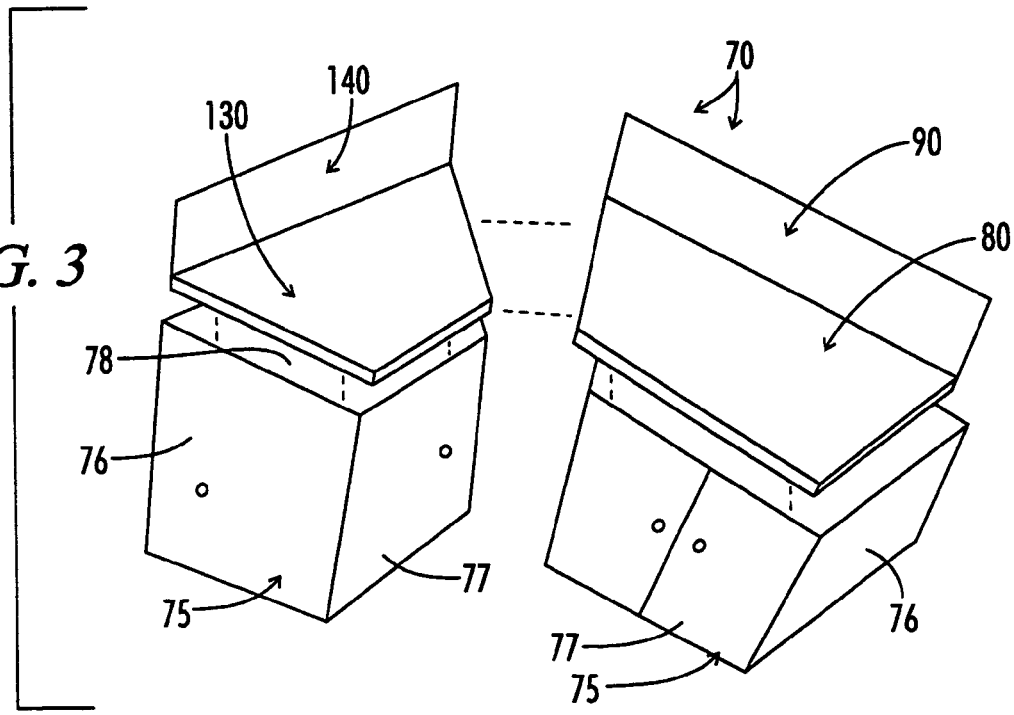

APPARATUS AND METHOD FOR SEAMLESS RIGID COUNTERTOP

CROSS-REFERENCE TO RELATED APPLICATIONS

This application claims priority to and is a continuation of U.S. patent application Ser. No. 10/961,390, filed Oct. 8, 2004 now abandoned, which is a continuation-in-part of U.S. patent application Ser. No. 10/395,487, filed Mar. 21, 2003 now abandoned, which was a continuation of U.S. provisional application Ser. No. 60/366,719 filed on Mar. 22, 2002.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

The present invention relates to a seamless rigid countertop and method therefor. A countertop in accordance with the present invention is tolerant of the harsh physical, chemical, and biological environments found in food preparation arenas and particularly kitchens. In particular, the present invention utilizes a combination of sheet metal characteristics melded with cabinet making skills coupled with powder coating to construct seamless rigid countertops. Countertops produced in accordance with the present invention are stable under temperature extremes (essentially inflammable), stain resistant, physically resistant to abrasions and chipping, resistant to chemical degradation from solvents and bleaches, have a continually smooth surface for easier sanitation from microorganism contamination, can be produced with a myriad aesthetically pleasing characteristics including color, shape, etc. Countertops can be easily powder coated again at a future time to repair blemishes or to create a desirable aesthetic décor. Known art may be found in U.S. Classes 524, 156, and 427, subclasses 71 and 430 as well as in other classes and subclasses.

2. Description of the Prior Art

Conventional countertops for kitchens and the like have proven useful as a flat work area. Such countertops are usually fitted above storage cabinets to thus provide double utility. When possible, unitary countertops without seams are preferred for several reasons. However, in many situations, and particularly in kitchens, unitary countertops without seams have not been practical because the room layout demanded countertops having divergent sections (i.e. U-shaped or L-shaped countertops). Countertops to accommodate such layouts have typically been assembled from discrete component segments to form a countertop assembly. Such an assembly inherently possessed seams between abutting discrete segments. Such seams were normally filled with caulk or the like in an effort to prevent infiltration by debris, liquids or the like and in an effort to cosmetically disguise the seam.

The modern kitchen countertop is therefore ordinarily an assembly of discrete abutting segments with seams between each segment and with the whole assembly installed on top of a cabinet foundation. The assembled countertop usually has a partially radiused front edge or lip and a raised rear backsplash usually six inches or less in height. It is preferable that the backsplash be an integral extension of the flat top surface of each segment rather than another discrete segment piece joined to the flat top since such a configuration would leave yet another seam between the back splash and the flat top surface of the countertop.

Countertops, especially those in food preparation arenas, must be durable since they are subjected to a harsh environment on a regular basis. These food preparation arenas including kitchens that can have an environment that may vary from very hot items just removed from a stove or oven or other heat source (which can be as hot as 500 degrees F.) to very cold items just removed from a freezer or refrigerator or other cold source (which can be as cold as 10 degrees F.). The environment also can be quite wet from fluid spills or dry from heated home interiors during the winter. Stains from minerals such as iron in the water to organic such as blood or food coloring; weathering from detergents, soaps, acids (vinegar) and household solvents (bleach) and ammonia water as well as physical gouging with knife points or edges are also common hazards. The environment often also includes biological agents such as *Escherichia coli, salmonella*, and other pathogenic microorganisms.

The countertop corners and edges can also create a safety hazard if too sharp. This is particularly true if someone slips and falls into them or otherwise bumps into these potential safety hazards and therefore care must be taken to ensure that such are not overly sharp or pointed.

Conventional countertops used in homes, especially kitchens, have for a long period been principally made from durable materials such as wood or masonry. Early masonry cabinets often used ceramic tile countertops since such were very durable and also a decorative material.

As new materials have been developed, many have been adapted as countertop material. Currently kitchen countertops can be constructed of wood, laminated materials, ceramic tiles, masonry stones such as granite, stainless steel and molded plastic, as well as a myriad of other materials. One commonality with many of these materials is that to keep costs low, the basic components come in predetermined lengths and styles from which discrete segments for a countertop are chosen and then these segments are typically assembled at the installation site. A frequent vexatious problem with most such assembled countertops involves the seams that invariably result between abutting segments.

Seams where the countertop segments join are often unsightly. The seams, if on an external corner, often snag clothing, dishtowels, etc. causing damage to these items. In addition, these can also snag flesh and cause bodily injury. Any seams where two component pieces of countertop butt against each other will pose an additional hazard. Seams provide access for fluid penetration, such as milk or the like. Penetrating fluids can subsequently spoil and cause repulsive odors and unsanitary conditions. The exposed seam in the counter top will also result in a hard to clean locale that can harbor pathogenic microorganisms. Of the foregoing materials, plastic is currently used to provide divergent countertops without seams but such is not without problem. For molded plastics, deviation from these predetermined dimensions results in substantial price increases as the fabrication process requires extensive time and specially trained craftsmen to be completed successfully, since special tools and procedures are necessary. If a shaped, one-piece part of continuous or monolithic plastic material is desired, such a part can only be produced by casting it in a mold cavity under special conditions. In addition to the high costs of such a process and for the installation of the parts (fitting, gluing it in place to a flat sheet, and/or finishing, for example,) there are often color differences between the cast bowl, for example, and the flat slab of the same material. These same economic facts will be true for any products that require casting in a mold.

In the past where metal has been used as a countertop material, it was painted, coated with enamel, or made from stainless steel. Those metal countertops that were painted had a tendency with time for the paint to peel and crack, were easily damaged by heat, and stained easily. Those countertops coated with enamel were prone to chip and be restrictive in the choice of colors and finishes. Stainless steel countertops were restricted to one appearance, that of "stainless steel" and are quite expensive and usually restricted to commercial applications. Metal countertops have also been generally restricted to straight runs of single sheet material and consequently not well adapted for divergent layouts without seams.

Recently, powder coatings, which are dry, finely divided, free flowing, solid materials at room temperature, have gained considerable popularity over liquid coatings for metallic substrates for a number of reasons. For one, powder coatings are user and environmentally friendly materials, since they are virtually free of harmful fugitive organic solvent carriers that are normally present in liquid coatings. Powder coatings, therefore, give off little, if any, volatile pollutants to the environment when cured. This eliminates many solvent emission problems associated with liquid coatings, such as air pollution or dangers to the health of workers employed in coating operations.

Powder coatings are also clean and convenient to use. They are applied in a clean manner over the substrate, usually metal, since they are in dry, solid form. The powders are easily swept up in the event of a spill and do not require special cleaning and spill containment supplies, as do liquid coatings. Working hygiene is, thus, improved. No messy liquids are used that adhere to worker's clothes and to the coating equipment, which leads to increased machine downtime and clean up costs.

Powder coatings are essentially 100% recyclable. Over sprayed powders can be fully reclaimed and recombined with the powder feed. This provides very high coating efficiencies and also substantially reduces the amount of waste generated. Recycling of liquid coatings during application is not done, which leads to increased waste and hazardous waste disposal costs.

Thus, powder coating is an advantageous method for protecting metal surfaces. However, powder coating has heretofore not been employed as a protective material for metal countertops.

In addition to meeting the above-described challenges, a material destined for use as a kitchen countertop, for example, should have a surface which is easily repairable and restored to its original appearance or new appearance to match new kitchen design decors, and be protected against flammability.

Thus, a need exists for an improved countertop that is aesthetically attractive with unitary or seamless construction, especially when employed in a complex divergent layout, while also providing good solutions to previous problems arising from the physical, chemical, and biological environments found in kitchens.

SUMMARY OF THE INVENTION

The present invention addresses the perceived need in the art. In accordance with one exemplary embodiment, a seamless rigid countertop is provided to redress the problems associated with known art. Powder coating yields countertops that have surfaces that are well covered. If the underlying substrate is smooth then the coating surface will be smooth as well, having only texture as the manufacturer dictates. The powder coats themselves are available in a myriad of colors. In addition the implementation of color patterns and textures is limited by the ingenuity of the powder coater. The powder coatings are physically tough. They substantially eliminate and are quite resistant to chipping, gauging, extremes in temperatures, wetness and humidity, and dissolution by solvents commonly used in households, and extremely stain resistant. The powder coated countertop tolerates temperature extremes, resists staining, expresses chemical stability to solvents, to lengthy exposure to water, to bleaches, to detergents, and other harsh chemicals while remaining relatively ease to sanitize. These countertops are also aesthetically attractive.

The present invention includes elements of cabinet construction, sheet metal working, and powder coating to produce a novel seamless countertop. The countertop has a metal core with a protective epoxy coating. The metal core enables a user to maintain several desirable characteristics of sheet metal working, including bending, shaping, cutting, and welding so that custom unitary countertops (especially u-shaped ones) can be made easily. The powder coating enables the metal surface to be protected from corrosion thus making desirable construction possible from cheaper materials and not restricted to stainless steel. In addition, the powder coating results in an exterior surface that is a chemically inert, being generally an epoxy material after curing. Epoxy materials are very resistant to degradation from chemical agents and physical abrasion.

The satisfaction of aesthetically pleasing requirements results from the elimination of seams in countertops that are unsightly and unsanitary, the attractive color pattern, and countertop shapes at the front edge, backsplash, etc. also can be customized as desired.

Tolerance to temperature extremes is a significant advantage in one exemplary embodiment of the present invention. The tolerance ranges from colder than objects found in kitchens to hotter than objects found in kitchens. This tolerance includes melting of the coating or otherwise defacing it from changes in color or deformation of the coating itself or the underlying core. The countertop itself is inflammable and therefore a good safety feature for kitchens.

The invention provides structures that may be easily sanitized. Structures in accordance with the present invention can be washed with strong bleaches, peroxides, detergents, acids, basics (household ammonia or lye), as well as degreasers etc. The seamless countertop surface greatly reduces the possibility of microorganism contamination due to physical inaccessibility for cleaning and/or sanitizing.

Physical resistance to abrasion is obtained from the hardiness of the powder coating as well as from the fact that the metal core gives rigidity so that the surface is resistant to penetration from such objects as knife points and cutting edges. The epoxy material resulting from powder coating does not chip or peel like paints and enamels.

The process for constructing a seamless powder coated countertop may be generally summarized as follows. Patterns for the countertop are acquired to obtain the necessary geometry of the final countertop. Next the core materials are assembled and cut into individual segments. Then the edges and backsplash are formed and/or shaped. The individual segments are integrated into an unitary assembly by using appropriate welding procedures or otherwise permanently affixing the segments together. The resulting metal unitary countertop is then smoothed and finished appropriately to remove all rough spots and sharp edges.

After the metal core is completed, it is prepared for subsequent powder coating by washing it with a conventional etching solution. The powder coat is then applied to the unitary metal core and cured by baking in an expansive oven.

The final step in the installation is the attachment of the assembled unitary countertop to the top of the cabinetry.

Thus, a principal object of the present invention to provide an improved seamless structure for countertops.

Another object of the present invention is to provide countertops that are durable under harsh physical and chemical environments.

Yet another object of the present invention to provide a seamless countertop that is easily sanitized.

Another object of the present invention is to provide a countertop that can be easily formed to give desired shapes to the front lip and backsplash.

Yet another object of the present invention is to provide a process for designing, fabricating and installing seamless countertops.

A further object of the present invention is to provide a countertop, which is inflammable.

An object of the present invention is to provide a countertop that can easily be given a new appearance to match a change in decors.

Another object of the present invention is to provide a countertop that can easily be repaired and restored to its original condition should it become damaged.

These and other objects and advantages of the present invention, along with features of novelty appurtenant thereto, will appear or become apparent in the course of the descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views:

FIG. 2 is an environmental view in accordance with one exemplary embodiment of the present invention;

FIG. 3 is a partially exploded, partially broken environmental view thereof;

DETAILED DESCRIPTION OF THE INVENTION

In accordance with one exemplary embodiment of the present invention, an apparatus and method is presented that provides a durable, unitary seamless rigid countertop that is powder coated and a process that provides a method of construction for seamless countertops. The accompanying FIGS. 1 through 23 show an exemplary process and various embodiments constructed in accordance with the teachings of the present invention. The present invention enables the user to advantageously combine cabinet making with metalworking and powder coating to produce novel seamless countertops.

Figure 1:
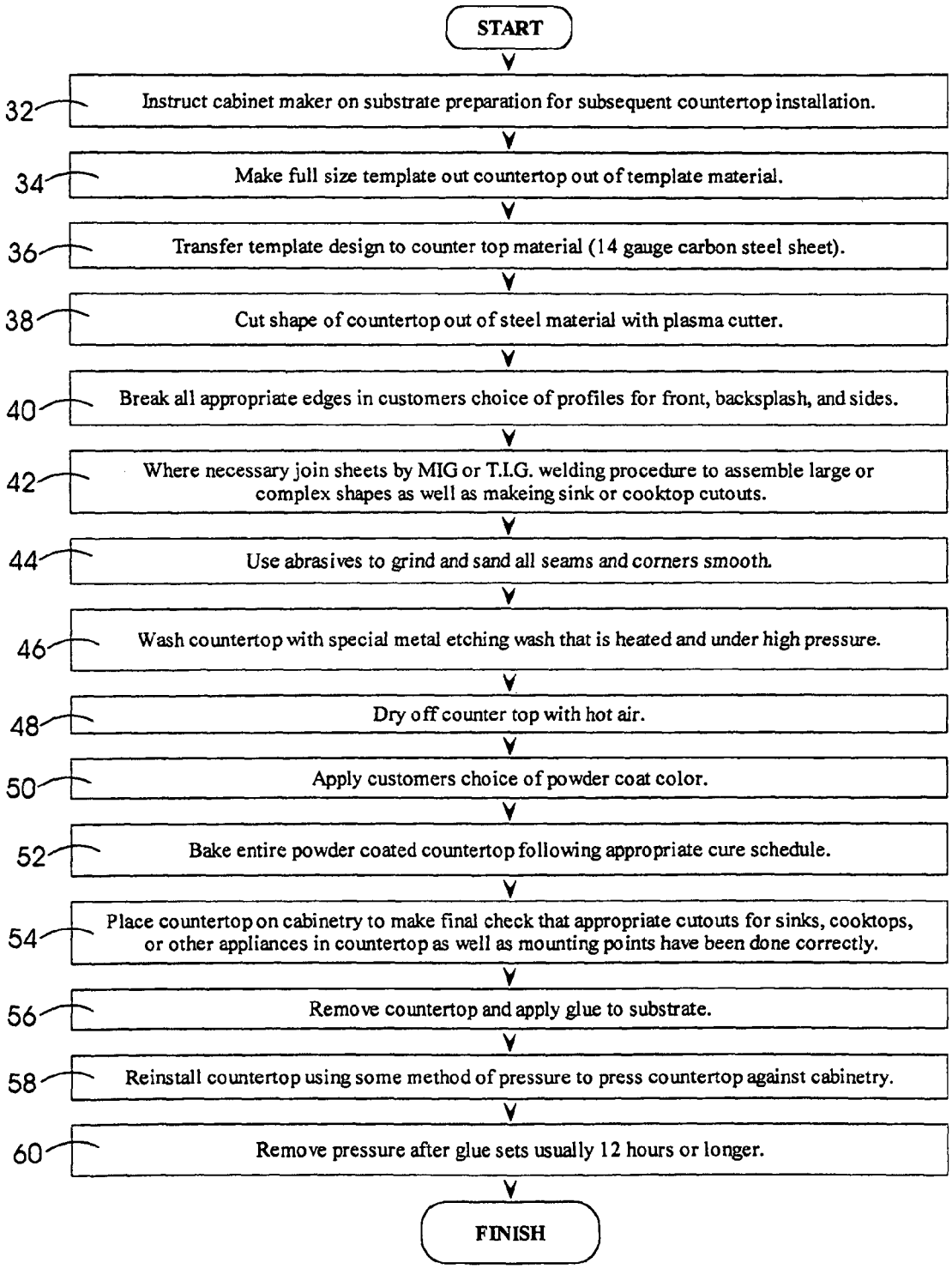
FIG. 1 is a process flow diagram for a seamless rigid countertop apparatus and method of fabrication in accordance with one exemplary embodiment of the present invention.
Figure 4:
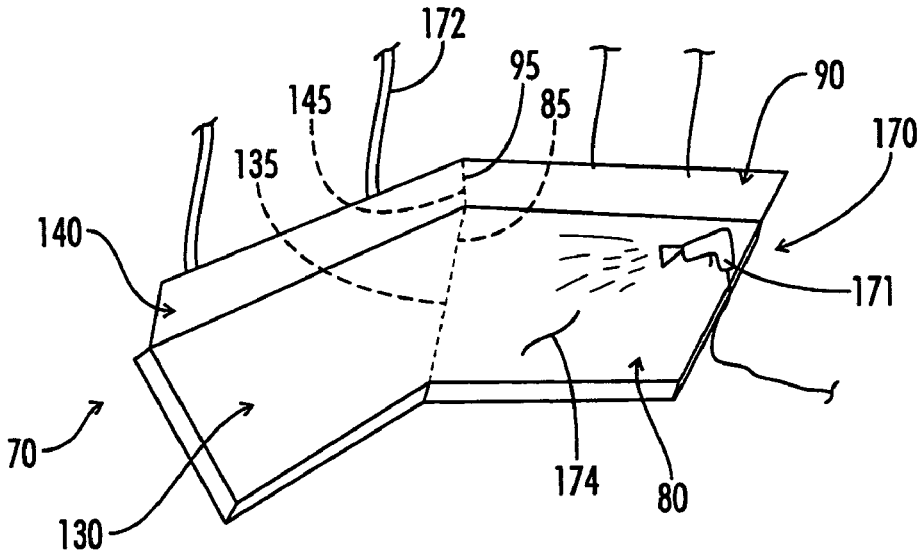
FIG. 4 is an environmental view showing the powder coat application process.

The process is briefly outlined in FIG. 1 as is generally indicated by reference numeral 30. The process begins with consultation with the cabinet-maker (indicated by step 32). As countertops are normally installed so that the top will be at a standard height unless specifically requested to be otherwise, adjustments must be made to the mounting points so that the final overall height from the floor to the countertop is the height desired. The mounting points must also be customized to meet the attachment requirements of novel seamless counter tops. This involves making sure that the distribution of the points as well as the total contact area will be sufficient to provide secure and well supported attachment.

To get dimensions correct and to coordinate the countertop attachment points on the supporting cabinetry with attachment loci on the countertop, a template is made (step 34). The template is made full size since this is needed to transfer the dimensions directly to the metal core materials (step 36). Since several metal pieces can be needed for one seamless countertop, care for construction allowances must be exercised at this stage.

Once the materials have been selected that are needed for a countertop, they must be cut to meet dimension requirements (step 38). A plasma cutter is best for the cutting job as less cleanup followed by preparation for the metal joining is required although it is to be understood that other conventional devices are acceptable as well. Cutouts, such as aperture 152, for sinks, cooktops, etc. are also made at this time so that the subsequent powder coating operation will coat the edges around the cutout thus protecting the metal substrate from exposure to the environment.

The metal edges need to be formed prior to welding pieces together (step 40). If not formed prior to welding, the metal stock will not necessarily fit into the bending machinery. The profiles for the seamless countertop's front edge, sides, and backsplash all are shaped at this time.

Sheets are joined where necessary using MIG or T.I.G. welding (step 42). In this manner large countertops can be assembled that include multiple units as necessary to obtain the overall desired dimension and complex shape as well as giving the capability of including subunits that have special features such as sink cutouts, shelving, spice racks, etc. The welding operation, which actually melts the metal substrate while adding some molten filler metal, is fundamental to the seamless construction. The reason for this is that the welded joint is as strong or stronger than the metal that the weld joins.

The welded joint with proper finishing becomes part of a contiguous surface (step 44). The countertops metal core is finished with smoothing operations that range from grinding with emery wheels to sanding etc. as necessary to provide rounded edges and corners as well as a smooth surface. Any blemishes or imperfections can also be repaired at this time and re-smoothed as necessary to attain an acceptable metal core.

The preparation of the metal countertop core for subsequent powder coating is the next step (box 46). A hot etching solution is sprayed on the metal countertop core using a high-pressure washer. The countertop is subsequently dried using hot air (step 48).

The powder coat is applied with a powder coat gun (step 50). There are a myriad of colors from various manufacturers for the customer to choose from. Usually all are applied similarly, if not the manufacturers application directions need to be followed.

Curing the entire countertop (at step 52) follows the powder coat application step. Various powder coats have different cure schedules and these must be adhered to rigorously to get consistently acceptable results. All schedules require baking the powder coat at elevated temperatures in an oven for specific time intervals. After the curing operation is completed the countertop must cool for subsequent handling. At the completion of the curing process, the powder coated countertop will not have any visual or other physical discernable characteristics due to differences in the metal substrate to which it was applied, thus the final finish will be seamless in appearance as well as other properties.

The countertop is placed on the cabinetry for final adjustments (step 54). These adjustments could include double checking cutouts for sinks, cooktops, etc. At this time the cabinetry itself is checked to ensure that mounting points have been correctly prepared and adjusted as necessary in preparation for the final installation steps that follow.

The countertop is removed and glue applied to substrate as necessary (step 56). The countertop is repositioned in its desired final location (step 58) and pressure is applied to press the contact locations between the countertop and supporting cabinetry together. After the glue cures (follow manufacturers recommendations), remove pressure from the countertop completing the installation.

One exemplary embodiment of the present invention 70 is shown in FIG. 2. The invention 70 rests on cabinetry 75, which typically has sides 76 and doors 77. The present invention 70 has components 80 and 130. Component 80 of the present invention has substructures indicated by the backsplash 90, end edge 110, and front edge 100. The flat surface 84 of the component 80 is joined to the backsplash surface 92 at crease 94. Component 130 of the present invention has substructures indicated by the backsplash 140, side edge 160, and end edge 150. The flat surface 134 of subunit 130 is joined to the backsplash at crease 144. The two subcomponents of the present invention have edge 85 joined to edge 135 and edge 95 joined to edge 145. All surfaces of all components of the present invention are covered with an epoxy coating.

The spatial configuration of components 80 and 130 to each other and the supporting cabinetry 75 is shown in FIG. 3. An exemplary mounting surface 78 is where the present invention 70 is attached to the supporting cabinetry 75.

The powder coating operation (FIG. 4) is done to the entire surface of the present invention 70. The present invention 70 has an electrostatic charge applied using electrodes 172. The powder coat 174 is applied with a powder coat gun 171.

Figure 5:
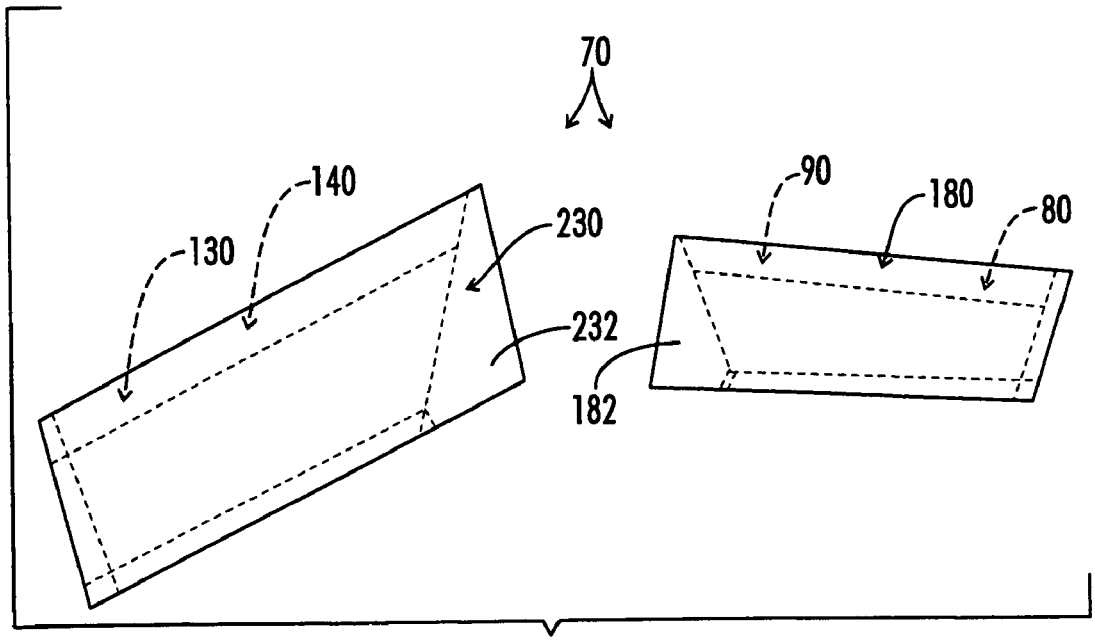
FIG. 5 is an environmental view showing the pattern on various discrete components thereof.
Figure 6:
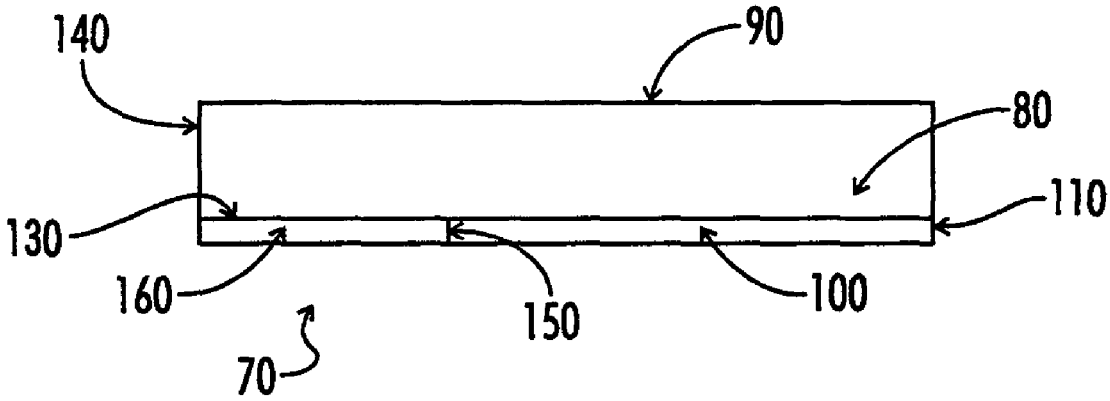
FIG. 6 is a side elevational view thereof.

The components 80 and 130 of the present invention 70 are made from discrete pieces of sheet metal 180 and 230 as depicted in FIG. 5. The pattern from the template created in step 36 is transferred to the raw metal sheet stock 180 and 230. The waste materials 182 and 132 are removed as indicated in process step 38. The stock is next bent or broken at the creases and otherwise shaped as desired (step 40).

Figure 7:
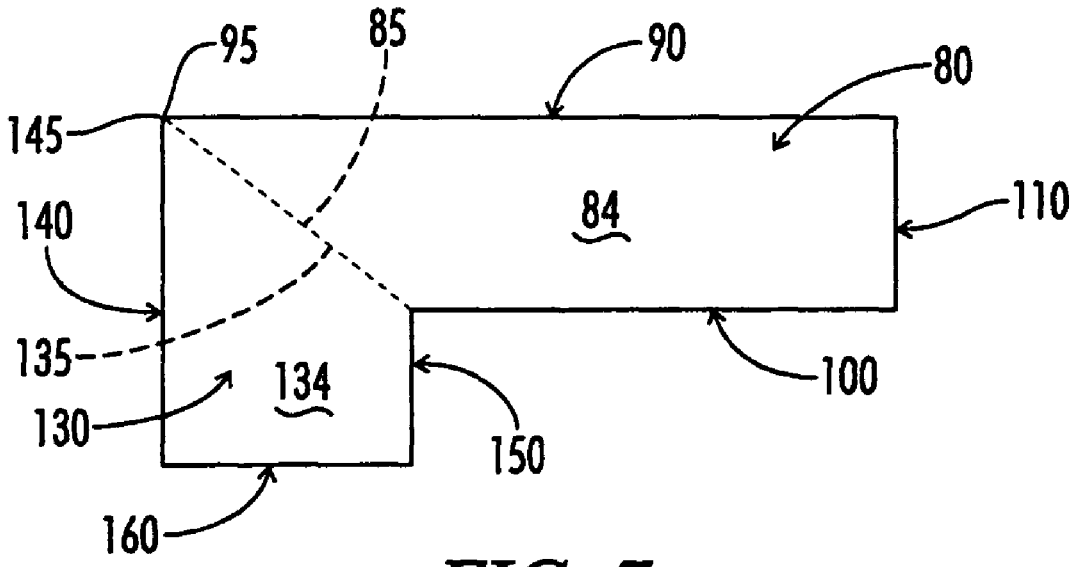
FIG. 7 is a top plan view thereof.

A side elevational view (FIG. 6) shows the perspective of said exemplary embodiment of the present invention 70 in FIG. 2. A top plan view of said embodiment is shown in FIG. 7.

Figure 8:
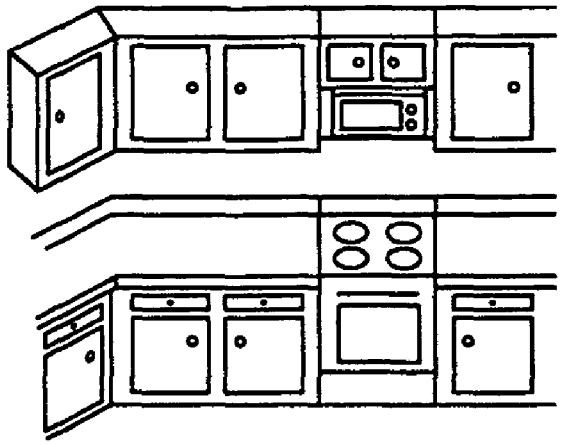
FIG. 8 is an environmental view of one embodiment of the present invention installed in a domestic kitchen.
Figure 9:
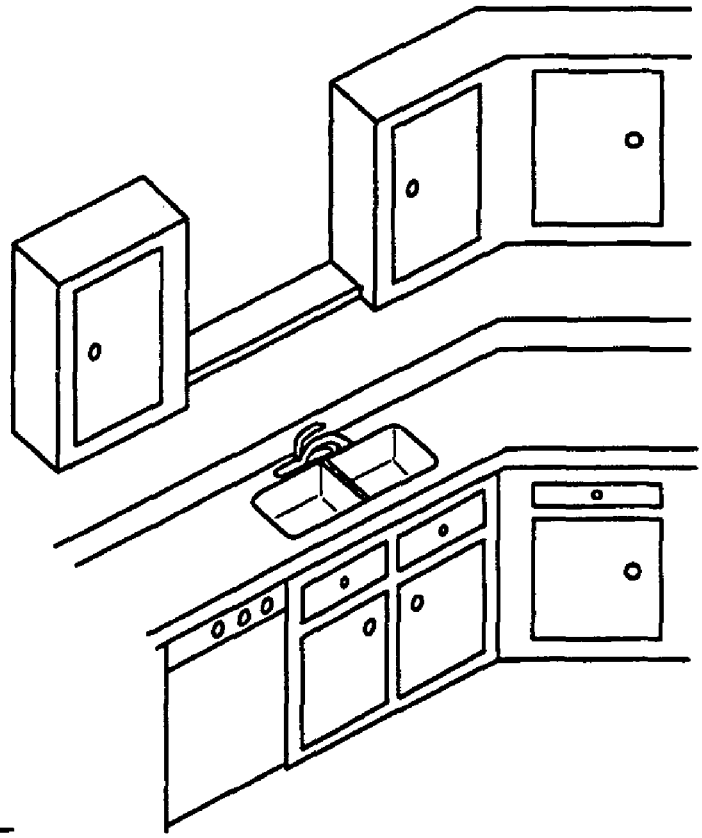
FIG. 9 is an enlarged view of the environmental view of the embodiment of the present invention shown in FIG. 8.
Figure 10:
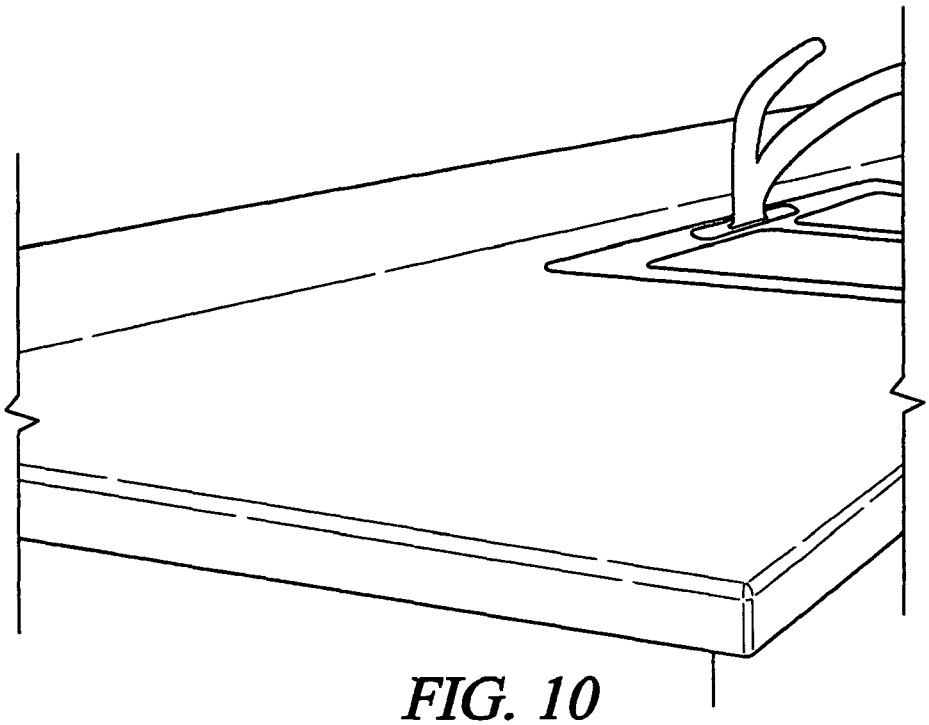
FIG. 10 is an enlarged view of the environmental view of the embodiment of the present invention shown in FIG. 8.
Figure 11:
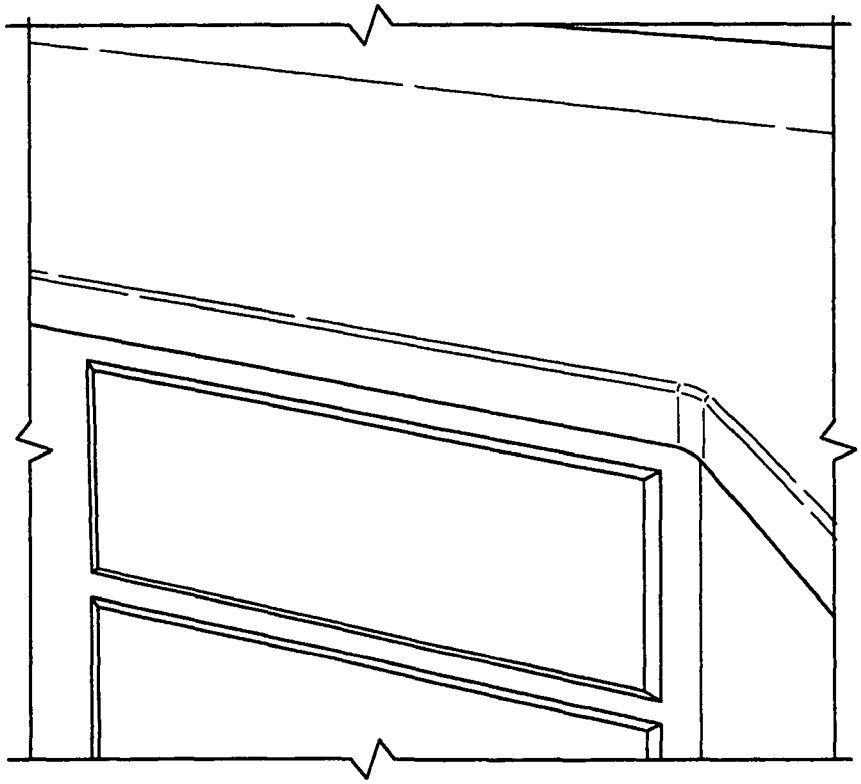
FIG. 11 is an enlarged view of the environmental view of the embodiment of the present invention shown in FIG. 8.
Figure 12:
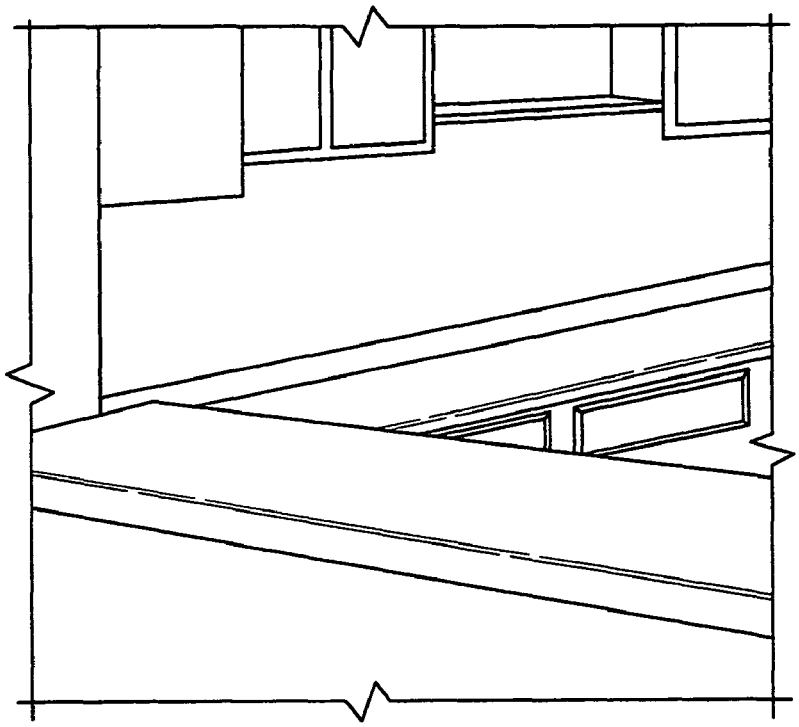
FIG. 12 is an enlarged view of the environmental view of the embodiment of the present invention shown in FIG. 8.
Figure 13:
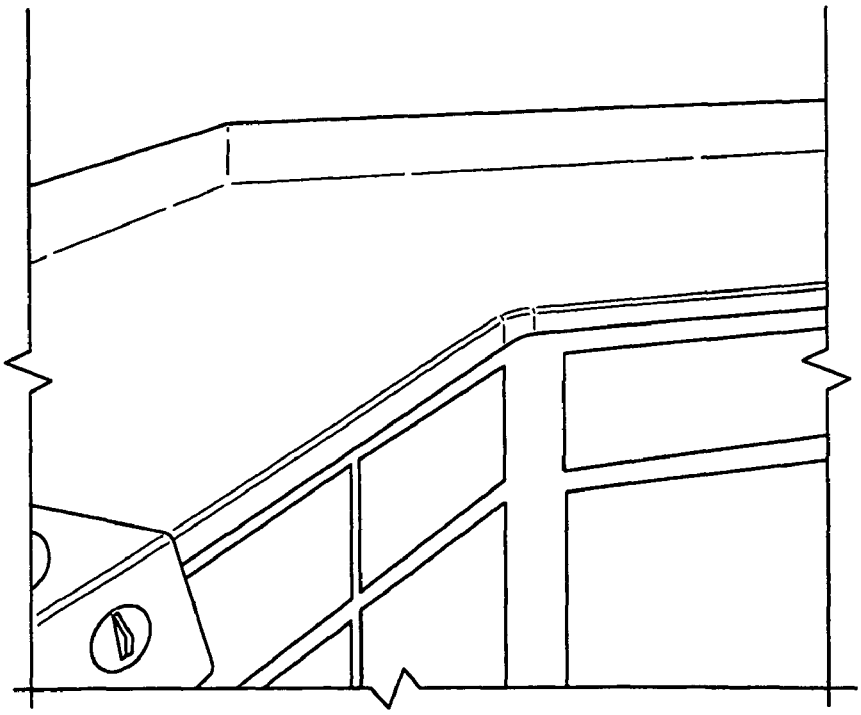
FIG. 13 is an enlarged view of the environmental view of the embodiment of the present invention shown in FIG. 8.
Figure 14:
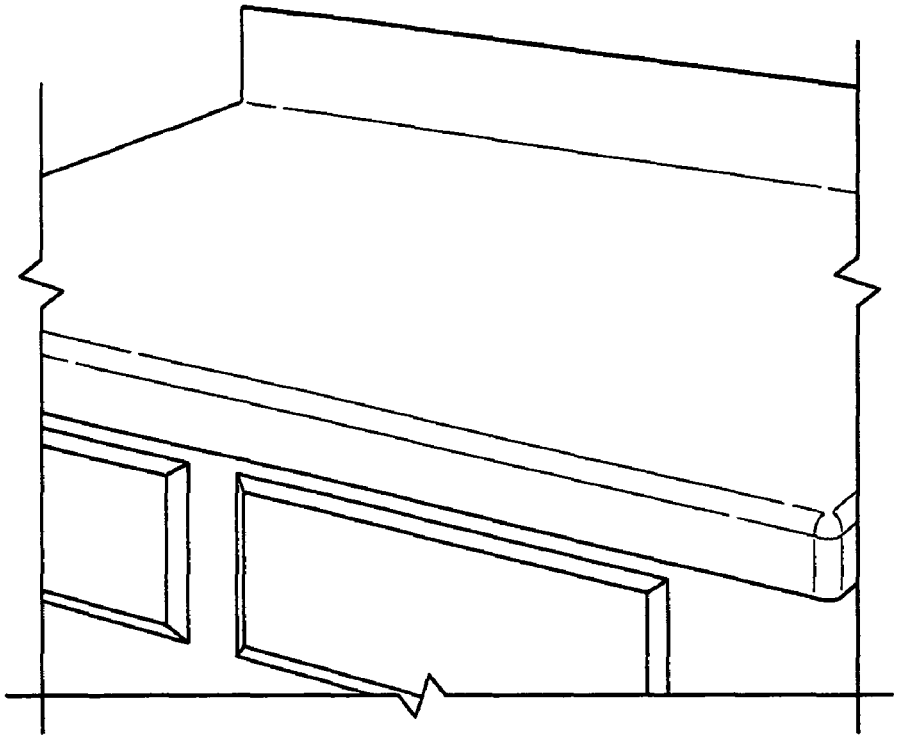
FIG. 14 is an environmental view of one embodiment of the present invention that matches the finish of the one shown in FIG. 8.

One exemplary embodiment of a seamless countertop in a domestic kitchen is shown in FIG. 8. Subsequent views of portions of the exemplary embodiment shown of FIG. 8 are given in FIGS. 9 through 14 to illustrate the seamless nature of front edge (FIG. 10), angles (FIGS. 11 and 13), corners (FIGS. 10 and 14), ability to produce small décor coordinated objects (FIG. 12), installation of fixtures and appliances in the seamless counter top (FIGS. 9 and 10), and the seamless nature of the entire countertop structure as exemplified by FIGS. 8 through 14.

Figure 15:
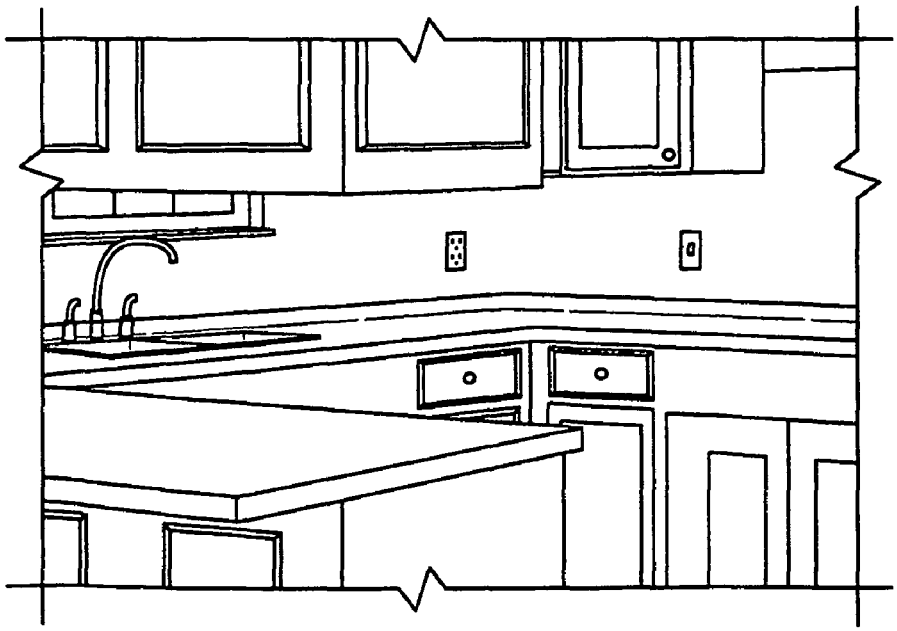
FIG. 15 is an environmental view of one embodiment of the present invention installed in a domestic kitchen.
Figure 16:
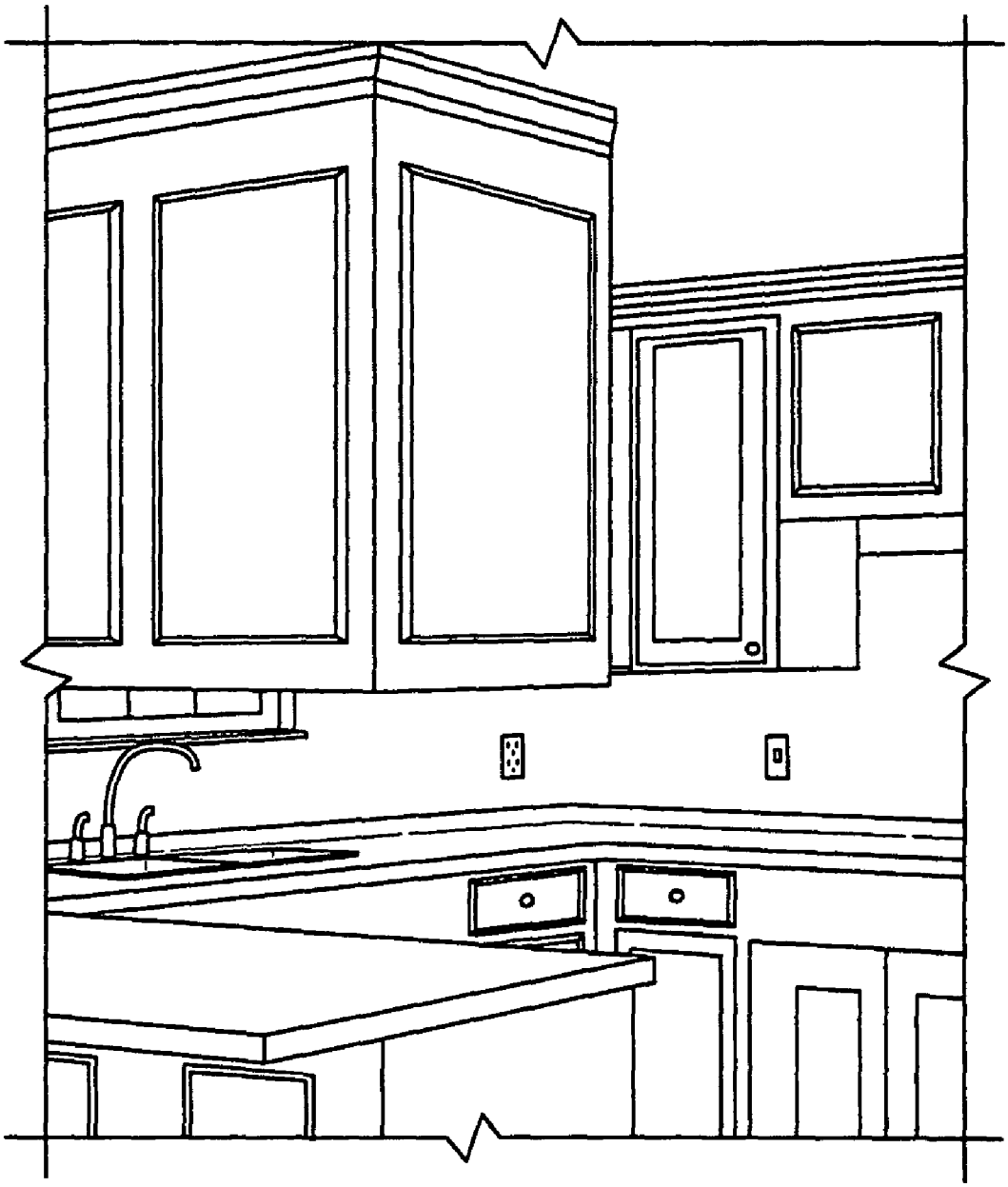
FIG. 16 is another environmental view of the embodiment of the present invention shown in FIG. 15.
Figure 17:
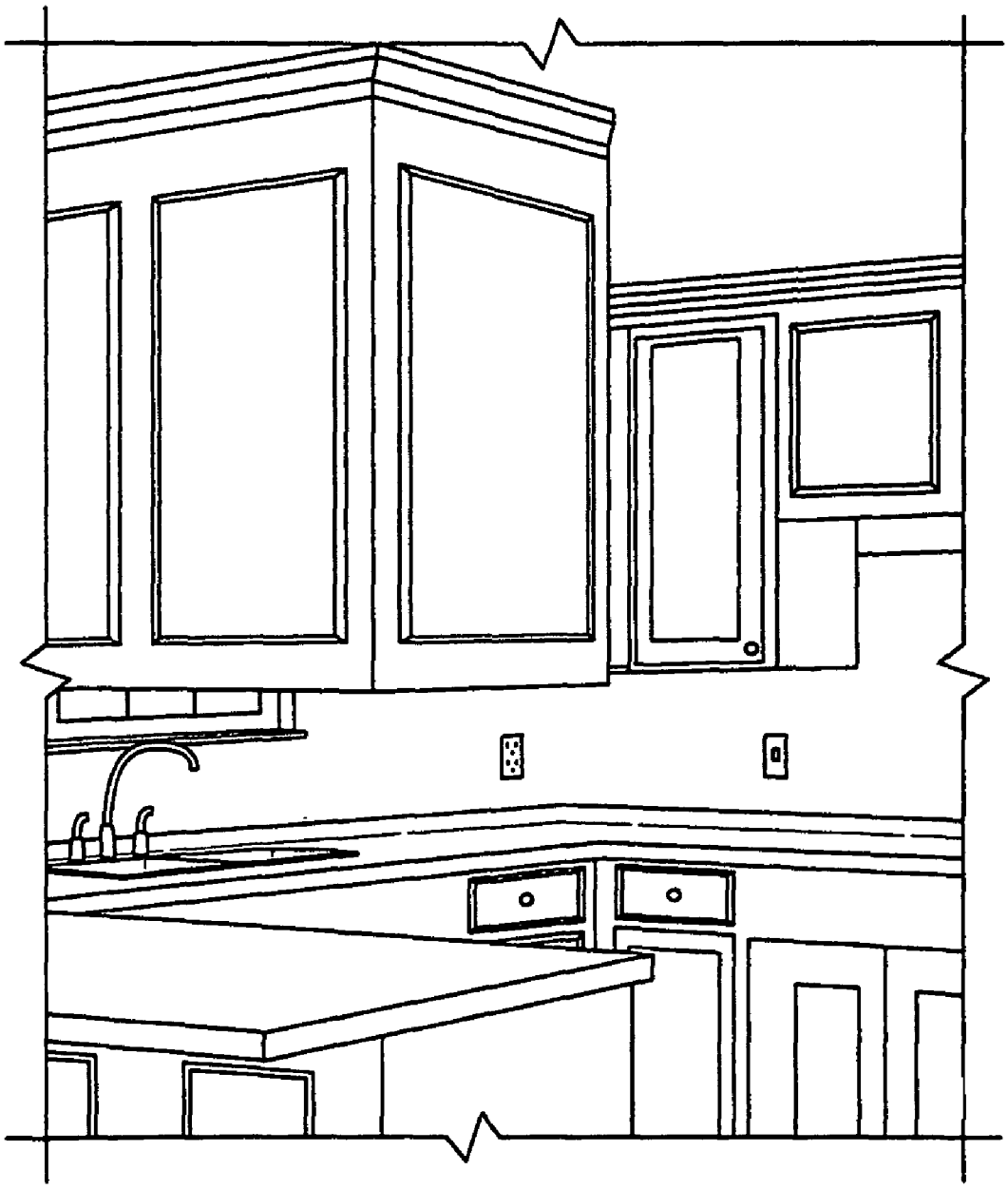
FIG. 17 is another environmental view of the embodiment of the present invention shown in FIG. 15.
Figure 18:
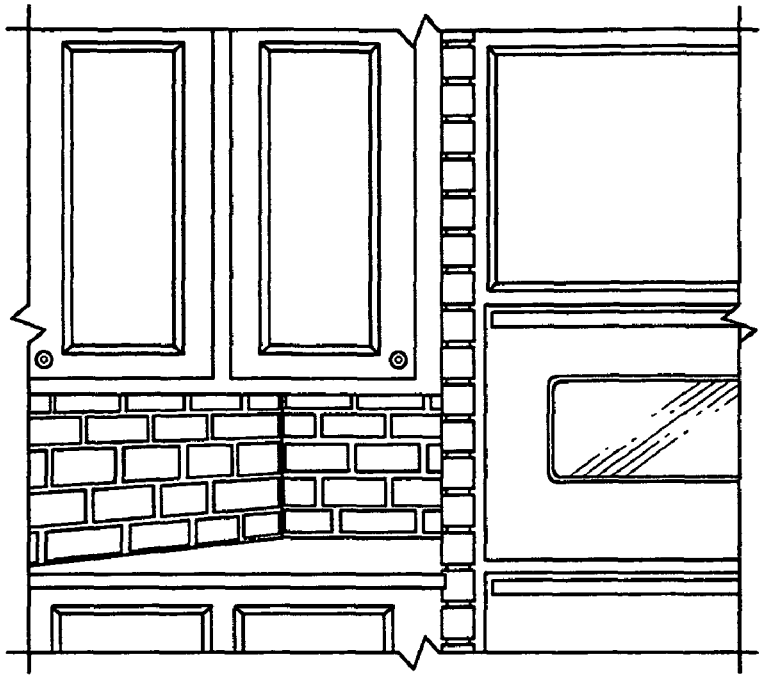
FIG. 18 is an environmental view of one embodiment of the present invention installed next to a stove in a domestic kitchen.
Figure 19:
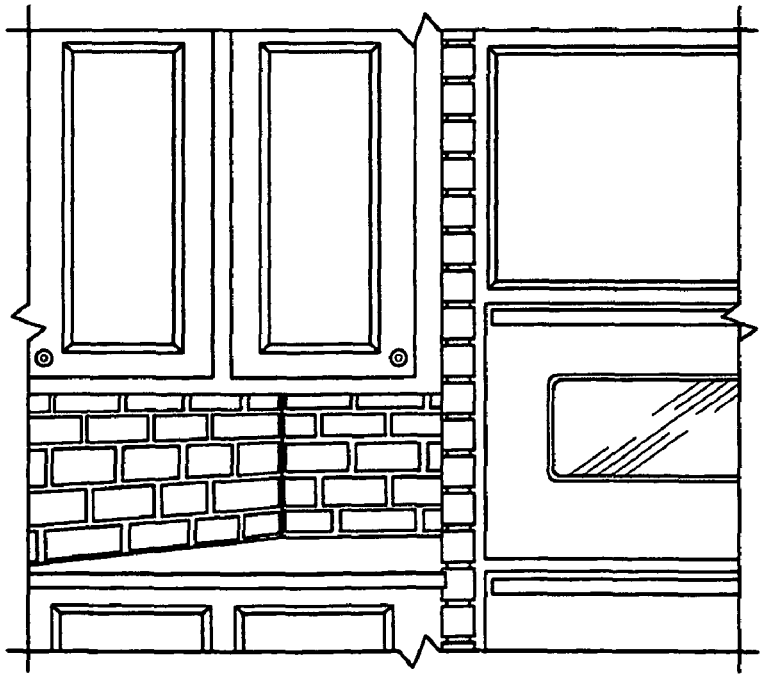
FIG. 19 is an environmental view of one embodiment of the present invention installed next to a stove in a domestic kitchen.
Figure 20:
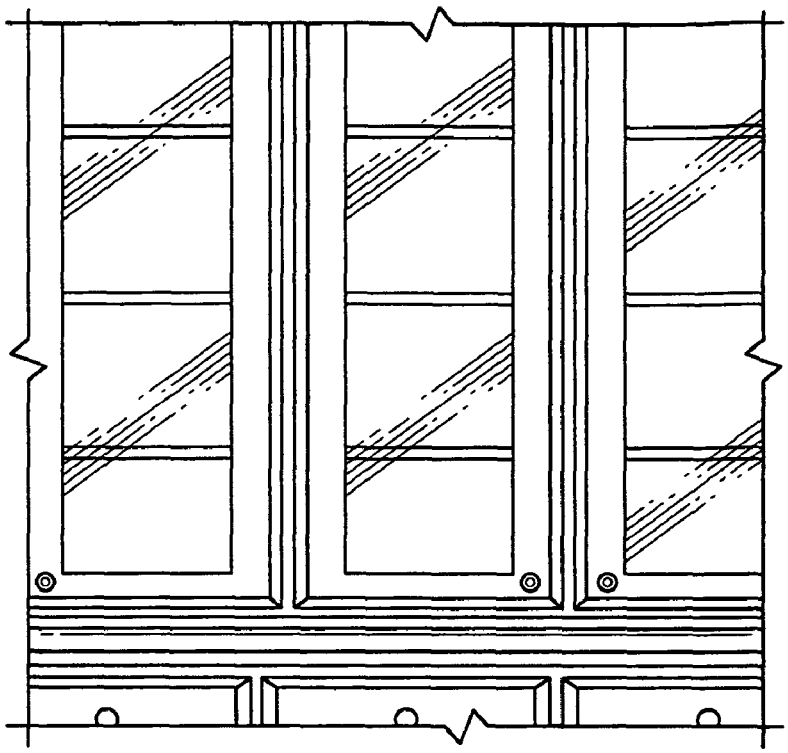
FIG. 20 is an environmental view of one embodiment of the present invention accenting a display cabinet in domestic kitchen.

Another exemplary embodiment of the invention is shown in FIG. 15, which illustrates the complexity of shape and size of the countertop that can be seamlessly produced as well as illustrating how colors can be chosen to match the decor. The appearance of objects under different lighting conditions such as direct versus indirect, natural versus artificial, etc. needs to be considered for aesthetic evaluation and alternative lighting of the countertop in FIG. 15 is presented in FIGS. 16 and 17 and for FIG. 18 is presented in FIG. 19. The exploitation of adventitious thermal properties as a design component is exemplified in FIG. 18. The strength that the metal core imparts to the countertop preventing deformation is illustrated in FIG. 20 where a hutch is resting directly on the counter top.

Figure 21:
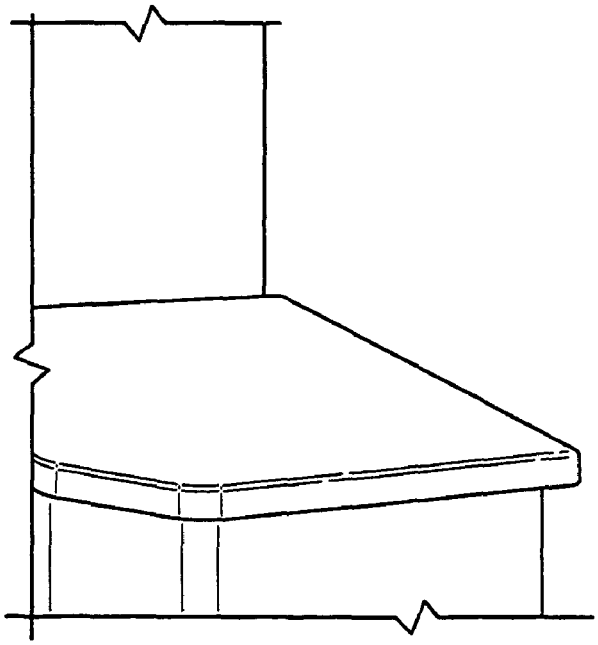
FIG. 21 is an environmental view of one embodiment of the present invention installed in a domestic kitchen.
Figure 22:
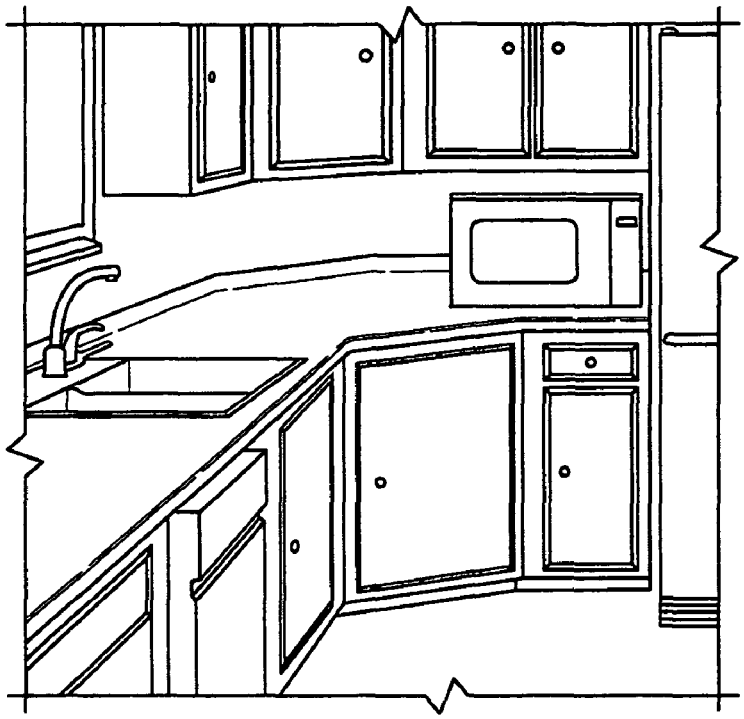
FIG. 22 is another environmental view of the embodiment of the present invention shown in FIG. 21.
Figure 23:
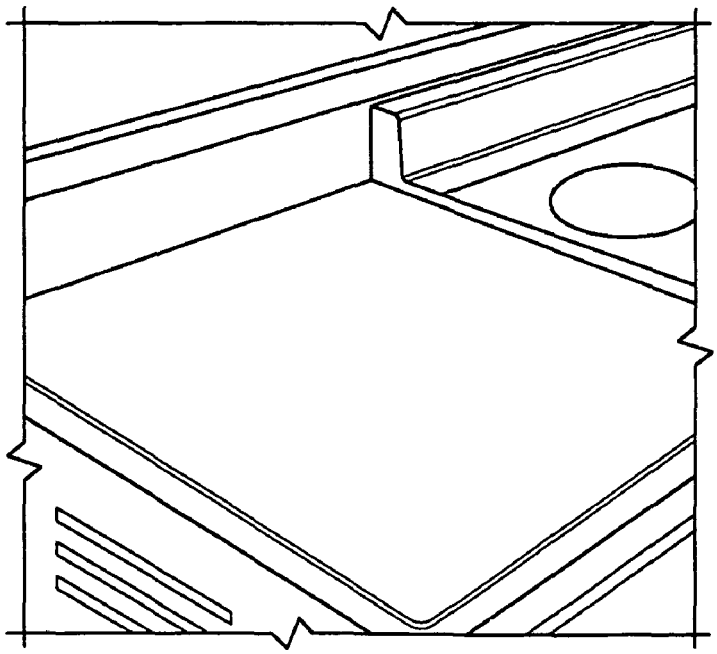
FIG. 23 is another environmental view of the embodiment of the present invention shown in FIG. 21.

Yet another exemplary embodiment of the invention is illustrated in FIGS. 21 through 23. The complexity of shapes for countertops are shown as well as the exploitation of the thermal properties (FIGS. 21 through 23), ease of sanitation for a snack or breakfast bar (FIGS. 22 and 23), the strength of the countertop in the hangover used in the breakfast bar (FIGS. 22 and 23), as well as another of the color choices that accent the totality of the kitchen décor.

The present invention provides a countertop without seams and general setting as shown in FIGS. 8-23. The effect of lighting on the present invention is shown in FIGS. 15-19 as described above. The exploitation of thermal and simultaneously decorative properties of the countertop is illustrated in the Figures, such as FIG. 18 and FIGS. 21-23. The countertop can have large dimensions in both width and length simultaneously as illustrated in one exemplary embodiment in the almost square countertop on the central island. The present invention provides resistance to strong chemical agents such as bleaches, detergents, and degreasers as well as exposure to prolonged contact with water. The aesthetically satisfying complementary color choice again partially exemplifies the scope and extent of the present invention's capacity to vary the countertop's surface color.

From the foregoing, it will be seen that this invention is one well adapted to obtain all the ends and objects herein set forth, together with other advantages that are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A method of forming seamless countertops comprising:

preparing a cabinet foundation for subsequent mounting of a seamless countertop;

assembling a template of said cabinet foundation for creating a countertop pattern to construct a seamless countertop from discrete metallic sheets;

transference of said countertop pattern from said template to said discrete metallic sheets followed by shaping said discrete metallic sheets by cutting, bending, and finishing said discrete metallic sheets according to said countertop pattern;

welding said discrete metallic sheets together at a weld joint to form a metal core;

smoothing the metal core and the weld joint between the discrete metallic sheets;

preparing said metal core by smoothing as necessary followed by chemically etching at least one surface of the metal core to provide a charged surface;

applying an oppositely charged material to said charged surface to create a unitary, seamless countertop;

thermally curing said unitary, seamless countertop; and attaching said unitary, seamless countertop to the cabinet foundation; wherein constructing a countertop from said discrete metallic sheets allows for customizing a seamless countertop of divergent layouts.

2. The method of claim 1 wherein said countertop is coated and cured at one time.

* * * * *